US008285184B2

(12) United States Patent
Law et al.

(10) Patent No.: US 8,285,184 B2
(45) Date of Patent: Oct. 9, 2012

(54) NANOCOMPOSITES WITH FLUOROPOLYMERS AND FLUORINATED CARBON NANOTUBES

(75) Inventors: Kock-Yee Law, Penfield, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 315 days.

(21) Appl. No.: 12/356,839

(22) Filed: Jan. 21, 2009

(65) Prior Publication Data

US 2010/0183348 A1 Jul. 22, 2010

(51) Int. Cl.
*G03G 15/20* (2006.01)

(52) U.S. Cl. ..... 399/333

(58) Field of Classification Search ..... 399/333, 399/329, 320
See application file for complete search history.

(56) References Cited

U.S. PATENT DOCUMENTS

| | | | | |
|---|---|---|---|---|
| 7,407,640 | B2 * | 8/2008 | Barrera et al. | |
| 7,732,029 | B1 * | 6/2010 | Moorlag et al. | 399/320 |
| 2005/0159540 | A1 * | 7/2005 | Goshiki | |
| 2005/0186378 | A1 * | 8/2005 | Bhatt | |
| 2006/0292360 | A1 * | 12/2006 | Hays et al. | |
| 2008/0152404 | A1 * | 6/2008 | Yoshino et al. | 399/329 |
| 2009/0117303 | A1 * | 5/2009 | Goshiki | |
| 2009/0123185 | A1 * | 5/2009 | Lin et al. | 399/320 |
| 2010/0055365 | A1 * | 3/2010 | Nakajima et al. | |
| 2010/0055450 | A1 * | 3/2010 | Qi et al. | |
| 2010/0055589 | A1 * | 3/2010 | Qi et al. | |
| 2010/0104332 | A1 * | 4/2010 | Law et al. | |
| 2010/0183864 | A1 * | 7/2010 | Qi et al. | |
| 2010/0233465 | A1 * | 9/2010 | Wu | |
| 2010/0286327 | A1 * | 11/2010 | Moorlag et al. | |

FOREIGN PATENT DOCUMENTS

| | | | |
|---|---|---|---|
| EP | 1936445 | | 6/2008 |
| EP | 1942161 | | 7/2008 |
| JP | 61137179 | A * | 6/1986 |
| JP | 10076563 | A * | 3/1998 |
| JP | 2003260708 | A * | 9/2003 |
| JP | 2005144751 | A * | 6/2005 |
| JP | 2005215133 | A * | 8/2005 |
| JP | 2006240938 | A * | 9/2006 |
| JP | 2007025475 | A * | 2/2007 |
| JP | 2007179009 | A * | 7/2007 |
| JP | 2007304374 | A * | 11/2007 |
| WO | WO 9959034 | A1 * | 11/1999 |
| WO | 2006046727 | | 5/2006 |

OTHER PUBLICATIONS

Chen et al., "In-Situ X-ray Deformation Study of Fluorinated Multiwalled Carbon Nanotube and Fluorinated Ethylene-Propylene Nanocomposite Fibers," Macromolecules, vol. 39, Nov. 16, 2006, pp. 5427-5437, XP002577585.

European Patent Office, European Search Report, European Application No. 10150627.7, Apr. 22, 2010, 3 pages.

* cited by examiner

*Primary Examiner* — Susan Lee

(74) *Attorney, Agent, or Firm* — MH2 Technology Law Group LLP

(57) ABSTRACT

In accordance with the invention, there are printing apparatuses, fuser members, and methods of making fuser members. The printing apparatus can include a fuser member, the fuser member including a substrate. The fuser member can also include one or more functional layers disposed over the substrate and a top coat layer including a fluorinated nanocomposite disposed over the one or more functional layers, wherein the fluorinated nanocomposite includes a plurality of fluorinated carbon nanotubes dispersed in one or more fluoropolymers.

18 Claims, 7 Drawing Sheets

NANOCOMPOSITES WITH FLUOROPOLYMERS AND FLUORINATED CARBON NANOTUBES

DESCRIPTION OF THE INVENTION

1. Field of the Invention

This invention relates generally to printing devices and, more particularly, to oil-less fusing subsystems and methods of using them 2. Background of the Invention In an electrophotographic printing apparatus, oil-less fuser top coat layers are generally made of the Teflon® family of polymers, for example, PTFE or PFA, due to their thermal and chemical stability; low surface energy; and good releasing properties. However, at fusing temperatures (around 200° C.), the mechanical strength of the Teflon® family of polymers is lower than that at room temperature, which can limit fuser life. Common failure modes of Teflon®-on-Silicone (TOS) material are top coat wear-off, wrinkle, and tread lines caused by edge wear. Incorporation of fillers, such as, for example, carbon nanotubes (CNT) into Teflon® family of polymers is expected to improve their mechanical strength, thermal and electrical conductivity. However, dispersion of CNTs in Teflon® family of polymers is known to be difficult because CNTs have atomically smooth non-reactive surfaces and fluoropolymers have low matrix surface tension. As a result, there is a lack of interfacial bonding between the CNT and the polymer chains. Furthermore, due to the van der Waals attraction, CNTs are held together tightly as bundles and ropes and therefore, CNTs have very low solubility in solvents and tend to remain as entangled agglomerates and do not disperse well in polymers, particularly fluoropolymers. Effective use of CNTs as fillers in composite applications depends on the ability to disperse CNTs uniformly throughout the matrix without reducing their aspect ratio. To overcome the difficulty of exfoliation and dispersion, mechanical/physical methods such as ultrasonication, high shear mixing, surfactant addition, melt blending, and chemical modification through functionalization have been studied in literature. Chemical modification and functionalization of CNTs, has been shown to provide bonding sites to the polymer matrix and may be a feasible method to disperse CNTs in a polymer matrix. Functionalization of CNT's with fluorine or fluorinated side chains are known and the resulting fluorinated CNT's have shown to improve dispersity in polymers. However, little work has been done on dispersing the fluorinated CNT's in fluoropolymers that are targeted for fuser applications such as, the Teflon® family of fluoropolymers, PTFE, PFA, and FEP.

Thus, there is a need to overcome these and other problems of the prior art and to provide fuser surfaces with well dispersed CNTs in Teflon® family of polymers in an oil-less fusing technology to improve mechanical strength and extend the fuser life.

SUMMARY OF THE INVENTION

In accordance with the various embodiments, there is a printing apparatus. The printing apparatus can include a fuser member, the fuser member including a substrate. The fuser member can also include one or more functional layers disposed over the substrate and a top coat layer including a fluorinated nanocomposite disposed over the one or more functional layers, wherein the fluorinated nanocomposite includes a plurality of fluorinated carbon nanotubes dispersed in one or more fluoropolymers.

According to various embodiments, there is a method of making a member of a fuser subsystem. The method can include providing a fuser member, the fuser member including a substrate. The method can also include forming one or more functional layers over the substrate and forming a top coat layer including a fluorinated nanocomposite over the one or more functional layers, wherein the fluorinated nanocomposite can include a plurality of fluorinated carbon nanotubes dispersed in one or more fluoropolymers.

According to another embodiment, there is a method of forming an image. The method can include providing a toner image on a media and providing a fuser subsystem including a fuser member, the fuser member including one or more functional layers disposed over a substrate and a top coat layer including a fluorinated nanocomposite disposed over the one or more functional layers, wherein the fluorinated nanocomposite can include a plurality of fluorinated carbon nanotubes dispersed in one or more fluoropolymers. The method can also include feeding the media through a fuser nip such that the toner image contacts the top coat layer of the fuser member in the fuser nip and fuse the toner image onto the media by heating the fusing nip.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
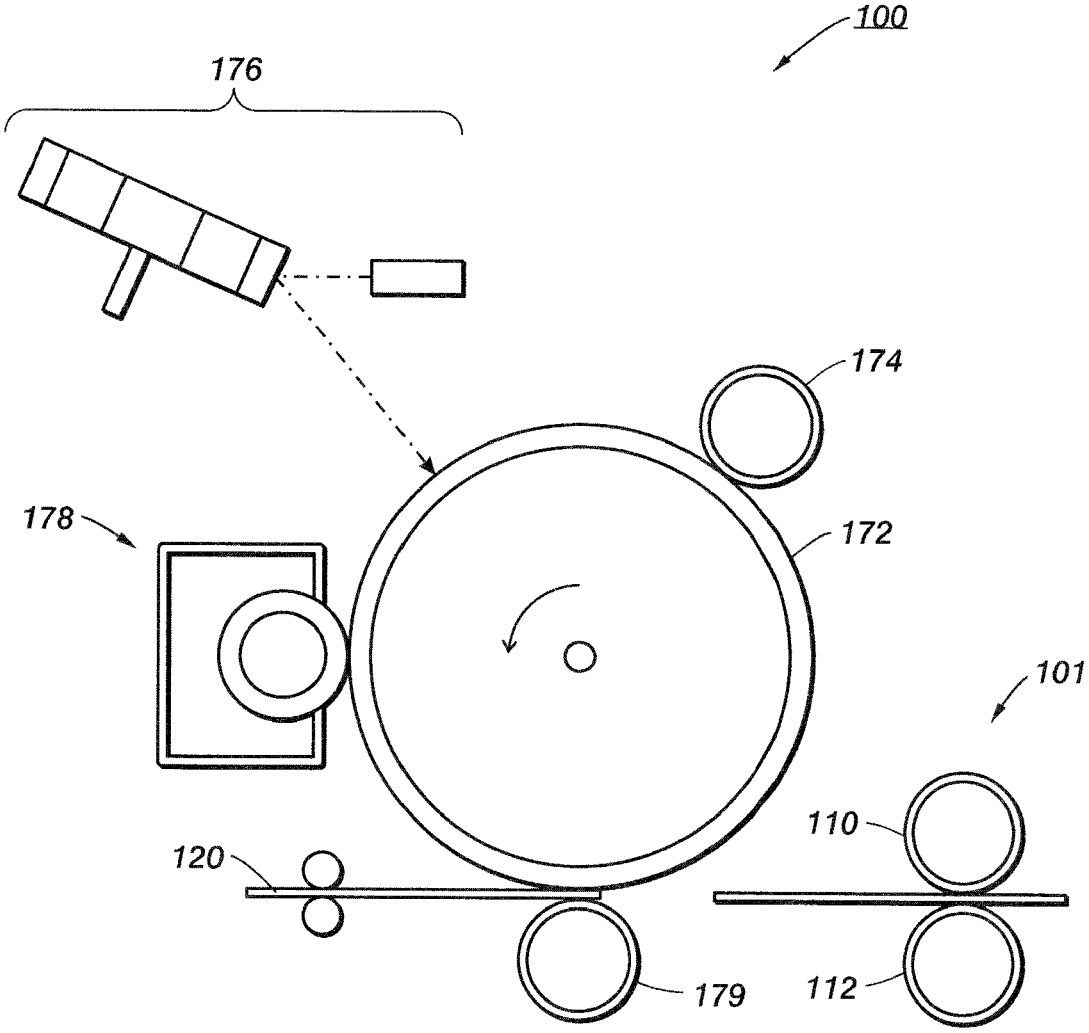
FIG. 1 schematically illustrates an exemplary printing apparatus, according to various embodiments of the present teachings.
Figure 3:
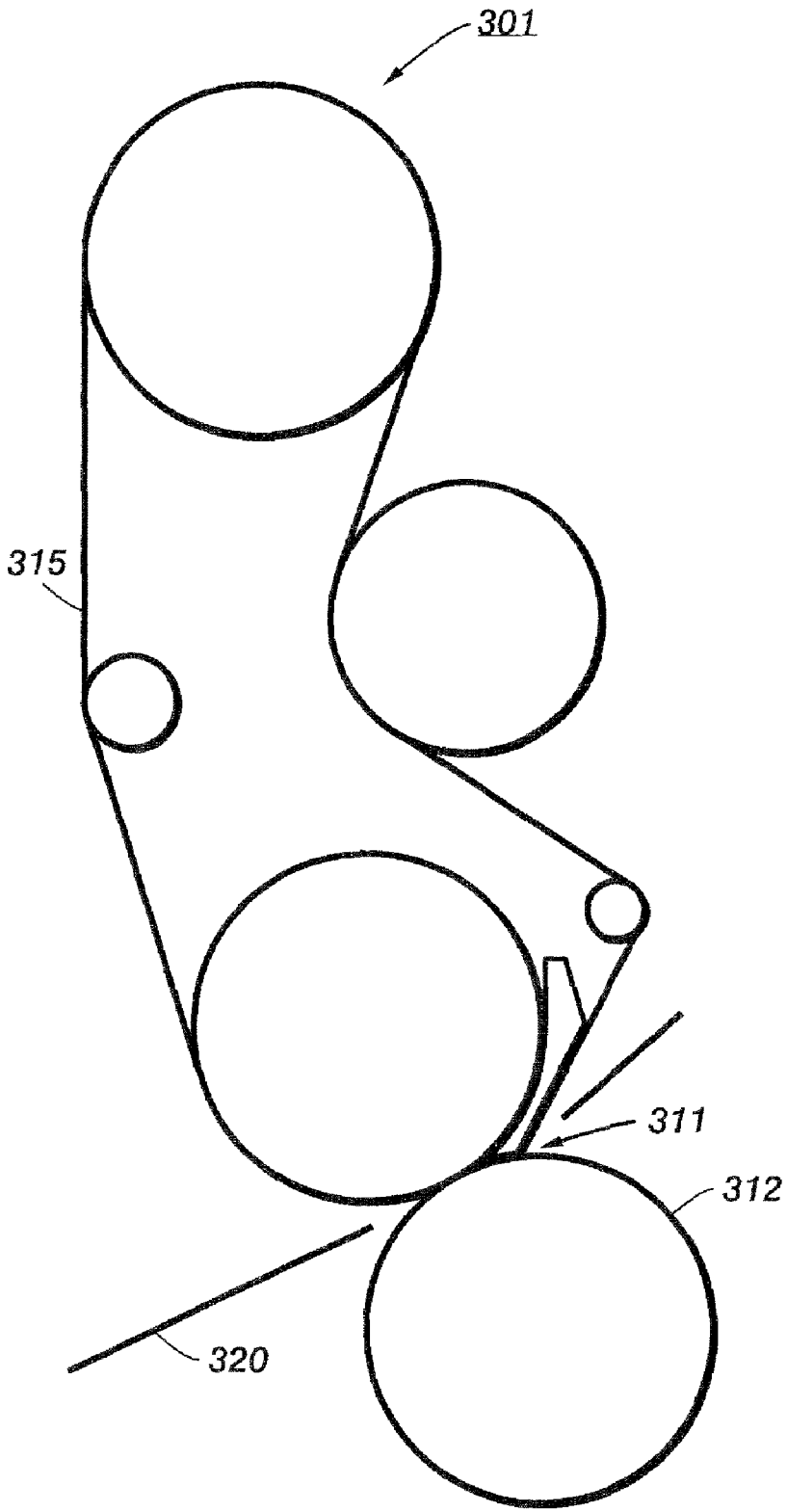
FIG. 3 schematically illustrates an exemplary fuser subsystem in a belt configuration of a printing apparatus, according to various embodiments of the present teachings.

FIG. 1 schematically illustrates an exemplary printing apparatus 100. The exemplary printing apparatus 100 can be a xerographic printer and can include an electrophotographic photoreceptor 172 and a charging station 174 for uniformly charging the electrophotographic photoreceptor 172. The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media 120. The printing apparatus 100 can also include a fuser subsystem 101 for fixing the visible image onto the media 120. The fuser subsystem 101 can include one or more of a fuser member 110, a pressure member 112, oiling subsystems (not shown), and a cleaning web (not shown). In some embodiments, the fuser member 110 can be a fuser roll 110, as shown in FIG. 1. In other embodiments, the fuser member 110 can be a fuser belt 315, as shown in FIG. 3. In various embodiments, the pressure member 112 can be a pressure roll 112, as shown in FIG. 1 or a pressure belt (not shown).

Figure 2:
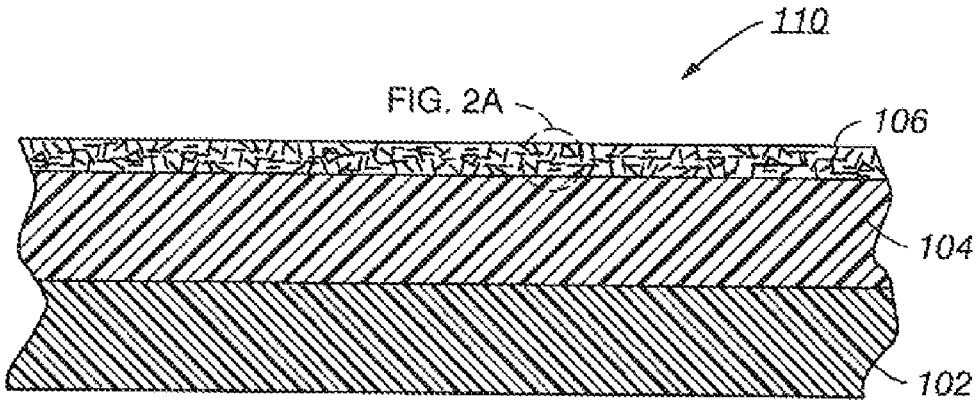
FIG. 2 schematically illustrates a cross section of an exemplary fuser member shown in FIG. 1, according to various embodiments of the present teachings.
Figure 2A:
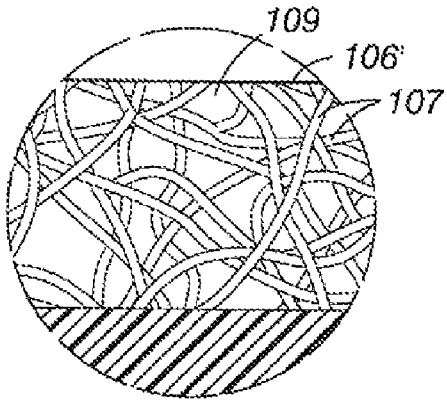
FIG. 2A schematically illustrates an exemplary fluorinated nanocomposite, according to various embodiments of the present teachings.

FIG. 2 schematically illustrates a cross section of an exemplary fuser member 110, in accordance with various embodiments of the present teachings. The exemplary fuser member 110 can include one or more functional layers 104 disposed over a substrate 102. In some embodiments, the one of the one or more functional layers 104 can be a compliant layer. The compliant layer 104 can include any suitable material, such as, for example, a silicone, a fluorosilicone, and a fluoroelastomer. In some cases, the compliant layer 104 can have a thickness from about 10 μm to about 10 mm and in other cases from about 100 μm to about 5 mm. The fuser member 110 can also include a top coat layer 106 including a fluorinated nanocomposite 106' disposed over the one or more functional layers 104, as shown in FIG. 2. FIG. 2A is a schematic illustration of an exemplary fluorinated nanocomposite 106' including a plurality of fluorinated carbon nanotubes 107 dispersed in one or more fluoropolymers 109. In some cases, the fluorinated carbon nanotubes 107 can be present in an amount of from about 0.05 to about 20 percent by weight of the total solid weight of the fluorinated nanocomposite 106' and in other cases from about 0.1 to about 15.0 percent by weight of the total solid weight of the fluorinated nanocomposite 106'.

In various embodiments, the plurality of fluorinated carbon nanotubes 107 can include one or more of a plurality of fluorinated single-walled carbon nanotubes (SWNT), a plurality of fluorinated double-walled carbon nanotubes (DWNT), and a plurality of fluorinated multi-walled carbon nanotubes (MWNT). In some embodiments, carbon nanotubes can be one or more of semiconducting carbon nanotubes and metallic carbon nanotubes. Furthermore, the carbon nanotubes can be of different lengths, diameters, and/or chiralities. The carbon nanotubes can have a diameter from about 0.5 nm to about 20 nm and length from about 100 nm to a few mm. A variety of methods of preparing fluorinated carbon nanotubes are available in literature, such as, for example, in Chen et. al., in Macromolecules, 2006, Vol. 39, No. 16, pp. 5427-5437; Hattori et. al, Carbon, 1999, Vol. 37, pp. 1033-1038; Mickelson et. al., J. Phys. Chem. B, 1999, Vol. 103, pp. 4318-4322; and Mickelson et. al., Chem. Phys. Lett., 1998, Vol. 296, pp. 188-194, the disclosures of which are incorporated by reference herein in their entirety. In certain embodiments, the one or more fluoropolymers 109 can include one or more of poly(tetrafluoroethylene), fluoro-ethylene-propylene copolymer, and perfluoroalkoxycopolymer. Exemplary fluorinated nanocomposite 106' present in the top coat layer 106 can include, but is not limited to multiwalled carbon nanotube/perfluoroalkoxycopolymer (MWNT/PFA) nanocomposite, and multiwalled carbon nanotube/poly(tetrafluoroethylene) (MWNT/PTFE) nanocomposite. Chen et. al. also discloses a method of forming a nanocomposite of fluorinated multiwalled carbon nanotube (MWNT) and fluorinated ethylene-propylene copolymer (FEP) by melt blending, the disclosure of which is incorporated by reference herein in its entirety. One of ordinary skill in the art would be able to apply Chen's method to form other fluorinated nanocomposites 106' than those disclosed in the publication. However, any other suitable method can be used to form fluorinated nanocomposite 106'. In some cases, the top coat layer 106 including fluorinated nanocomposites 106' can have a thickness from about 5 micron to about 150 micron and in other cases, from about 10 micron to about 75 micron. In various embodiments, the pressure members 112 as shown in FIG. 1 can also have a cross section as shown in FIG. 2 of the exemplary fuser member 110.

In various embodiments, the substrate 102 can be a high temperature plastic substrate, such as, for example, polyimide, polyphenylene sulfide, polyamide imide, polyketone, polyphthalamide, polyetheretherketone (PEEK), polyethersulfone, polyetherimide, and polyaryletherketone. In other embodiments, the substrate 102 can be a metal substrate, such as, for example, steel, iron, and aluminum. The substrate 102 can have any suitable shape such as, for example, a cylinder and a belt. The thickness of the substrate 102 in a belt configuration can be from about 25 μm to about 250 μm, and in some cases from about 50 μm to about 125 μm. The thickness of the substrate 102 in a cylinder or a roll configuration can be from about 0.5 mm to about 20 mm, and in some cases from about 1 mm to about 10 mm.

In various embodiments, the fuser member 110 can also include one or more optional adhesive layers (not shown); the optional adhesive layers (not shown) can be disposed between the substrate 102 and the one or more functional layers 104, and/or between the one or more functional layers 104 and the top-coat layer 106 to ensure that each layer 106, 104 is bonded properly to each other and to meet performance target. Exemplary materials for the optional adhesive layer can include, but are not limited to epoxy resin and polysiloxane, such as, for example, THIXON 403/404, Union Carbide A-1100, Dow TACTIX 740™, Dow TACTIX 741™, Dow TACTIX 742™, and Dow H41™.

FIG. 3 schematically illustrates an exemplary fuser subsystem 301 in a belt configuration of a xerographic printer. The exemplary fuser subsystem 301 can include a fuser belt 315 and a rotatable pressure roll 312 that can be mounted forming a fusing nip 311. In various embodiments, the fuser belt 315 and the pressure roll 312 can include one or more functional layers 104 disposed over a substrate 102 and a top coat layer 106 including a fluorinated nanocomposite 106' disposed over the one or more functional layers 104, as shown in FIG. 2, wherein the fluorinated nanocomposite 106' can include a plurality of fluorinated carbon nanotubes 107 dispersed in one or more fluoropolymers 109. A media 320 carrying an unfused toner image can be fed through the fusing nip 311 for fusing.

Figure 4:
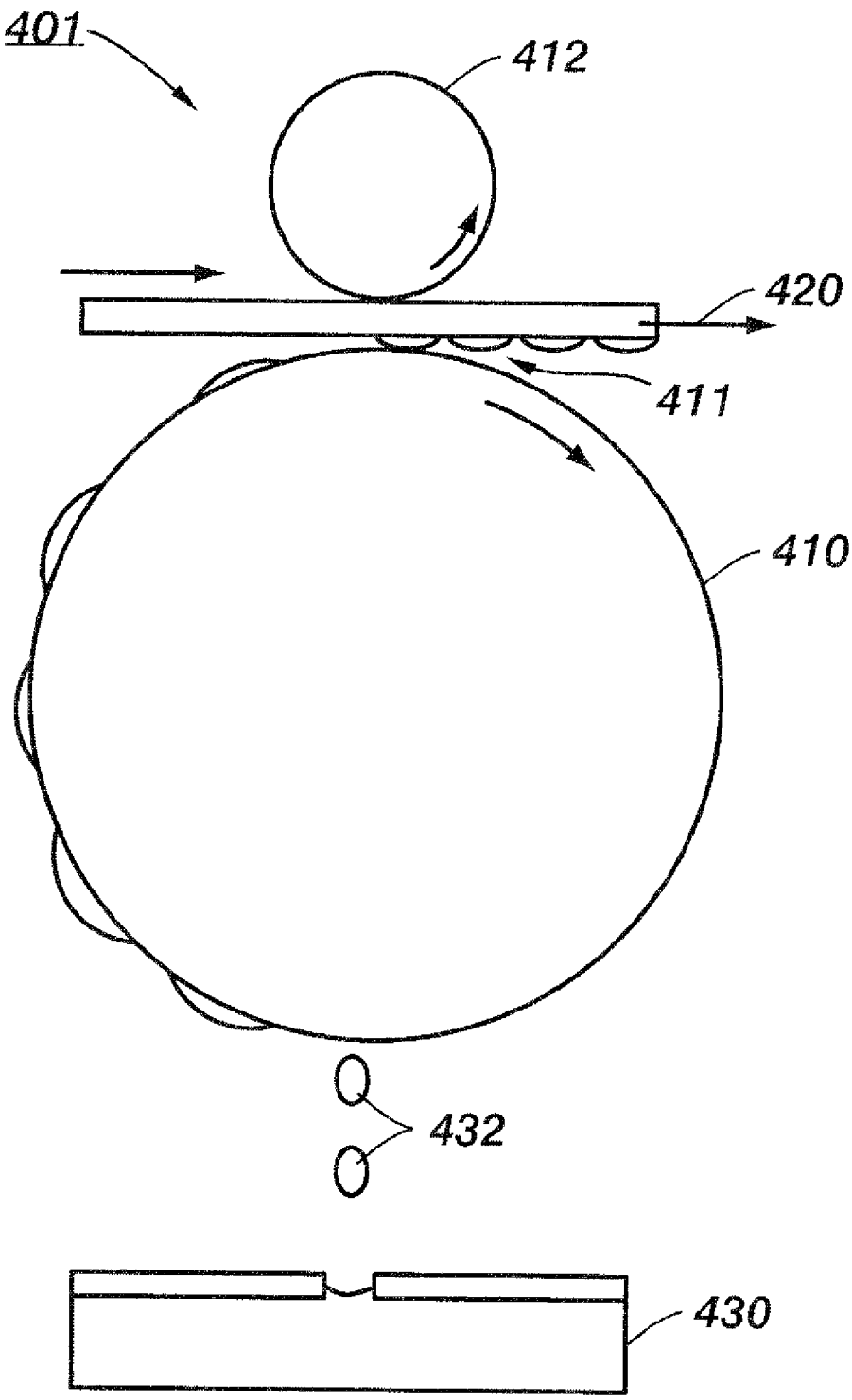
FIG. 4 schematically illustrates an exemplary transfix system of a solid inkjet printing apparatus, according to various embodiments of the present teachings FIG. 5 schematically illustrates exemplary image development subsystem, according to various embodiments of the present teachings.

In certain embodiments, the printing apparatus can be a solid inkjet printer (not shown) including an exemplary transfix system 401 shown in FIG. 4. The exemplary transfix system 401 can include a solid ink reservoir 430. The solid ink can be melted by heating to a temperature of about 150° C. and the melted ink 432 can then be ejected out of the solid ink reservoir 430 onto an image drum 410. In various embodiments, the image drum 410 can be kept at a temperature in the range of about 70° C. to about 130° C. to prevent the ink 432 from solidifying. The image drum 410 can be rotated and the ink can be deposited onto a media 420, which can be fed through a transfixing (transfusing) nip 411 between the image drum 410 and a pressure roll 412. In some embodiments, the pressure roll 412 can be kept at a room temperature. In other embodiments, the pressure roll 412 can be heated to a temperature in the range of about 50° C. to about 100° C. In various embodiments, the pressure roll 412 in can have a cross section as shown in FIG. 2 of the exemplary fuser member 110. The pressure roll 412 can include one or more functional layers 104 disposed over a substrate 102 and a top coat layer 106 including a fluorinated nanocomposite 106' disposed over the one or more functional layers 104 as shown in FIG. 2, wherein the fluorinated nanocomposite 106' can include a plurality of fluorinated carbon nanotubes 107 dispersed in one or more fluoropolymers 109.

Figure 5:
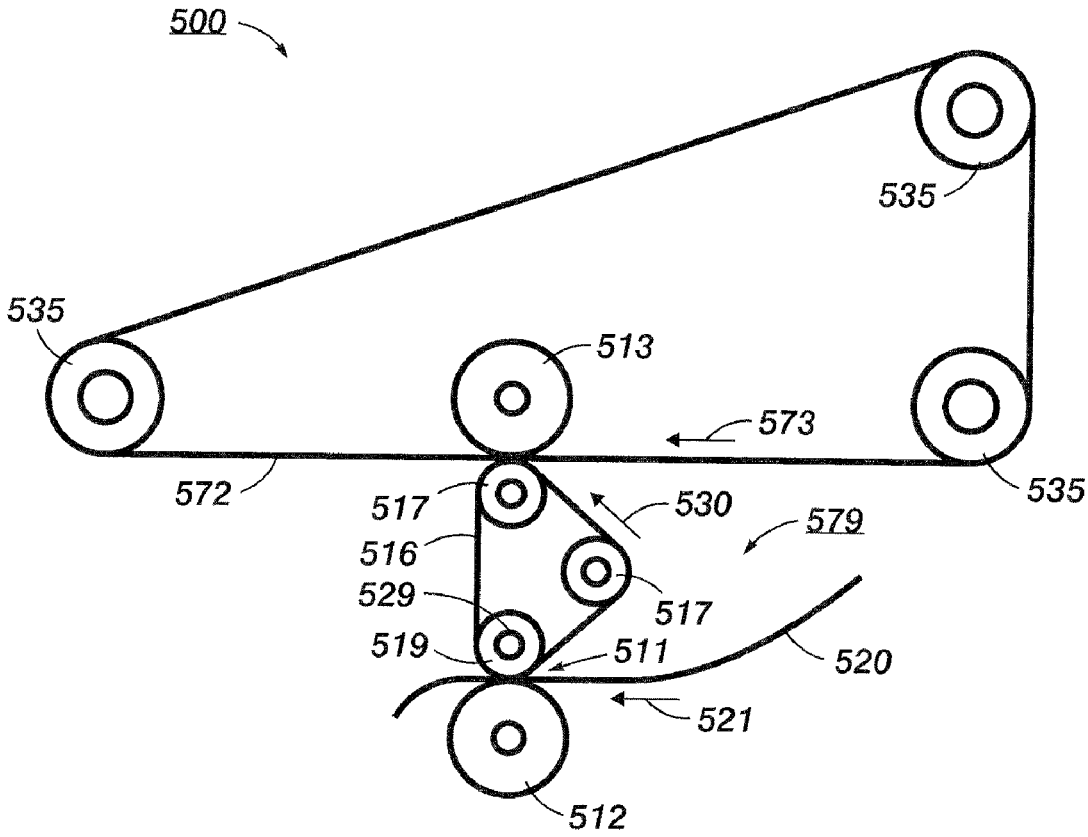

FIG. 5 illustrates an exemplary image development subsystem 500 in a xerographic transfix configuration, according to various embodiments of the present teachings. In the transfix configuration, the transfer and fusing occur simultaneously. As shown in FIG. 5, a transfer subsystem 579 can include a transfix belt 516 held in position by two driver rollers 517 and a heated roller 519, the heated roller 519 can include a heater element 529 In various embodiments, the transfix belt 516 can include one or more functional layers 104 disposed over a substrate 102 and a top coat layer 106 including a fluorinated nanocomposite 106' disposed over the one or more functional layers 104, as shown in FIG. 2, wherein the fluorinated nanocomposite 106' can include a plurality of fluorinated carbon nanotubes 107 dispersed in one or more fluoropolymers 109. The transfix belt 516 can be driven by driving rollers 517 in the direction of the arrow 530. The developed image from photoreceptor 572, which is driven in a direction 573 by rollers 535, can be transferred to the transfix belt 516 when a contact between the photoreceptor 572 and the transfix belt 516 occurs. The image development subsystem 500 can also include a transfer roller 513 that can aid in the transfer of the developed image from the photoreceptor 572 to the transfix belt 516. In the transfix configuration, a media 520 can pass through a fusing nip 511 formed by the heated roller 519 and the pressure roller 512, and simultaneous transfer and fusing of the developed image to the media 520 can occur. In some cases it may be necessary, optionally, to cool the transfix belt 516 before it re-contacts the photoreceptor 572 by an appropriate mechanism predisposed between the rollers 517.

The disclosed exemplary fuser members 110, 315, 516 and pressure members 112, 312, 412, 512 including a top coat layer 106 disposed over the one or more functional layers 104, the top coat layer 106 including a fluorinated nanocomposite 106' are believed to have improved mechanical properties at fusing temperatures as compared to conventional fuser members and pressure members without fluorinated nanocomposite 106'. While not bound by any theory, it is also believed that the enhancement in mechanical properties is due to the formation of fibrous network within the fluorinated nanocomposite resulting from high compatibility between the fluorinated carbon nanotubes and the fluoropolymers. Furthermore, the improvement in mechanical properties is expected to extend the life of fuser members 110, 315, 516 and pressure members 112, 312, 412, 512. Since, carbon nanotubes can impart their electrical conductivity to the nanocomposite, therefore, the top coat layer 106 besides being mechanically strong, can be electrically conductive and can dissipate any electrostatic charges created during the fusing process. Furthermore, carbon nanotubes can increase the thermal conductivity of the nanocomposite and preliminary modeling study has revealed that the operating temperature of the fuser can be reduced as a result. In addition, the use of the fluorinated nanocomposite 106' in the top coat layer 106 of the fuser members 110, 315, 516 and pressure members 112, 312, 412, 512 can also decrease the fusing time, thereby can increase the speed of the whole printing apparatus.

Figure 6:
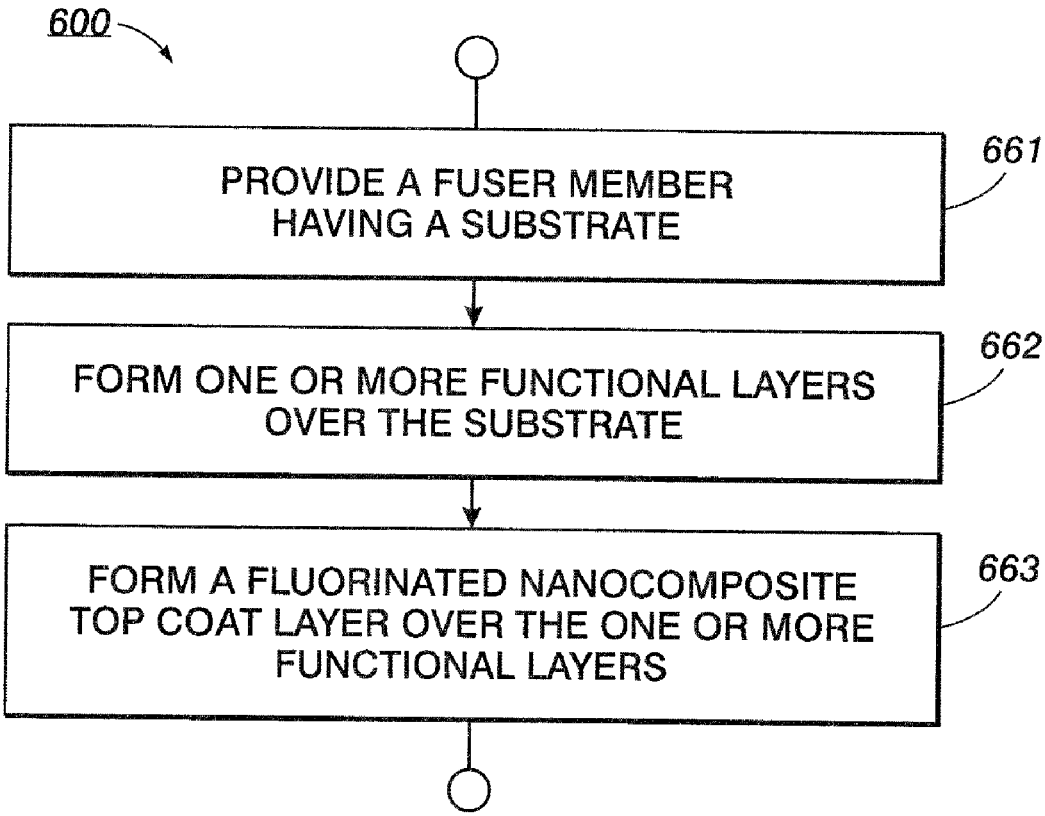
FIG. 6 shows an exemplary method of making a member of a fuser subsystem, according to various embodiments of the present teachings.
Figure 7:
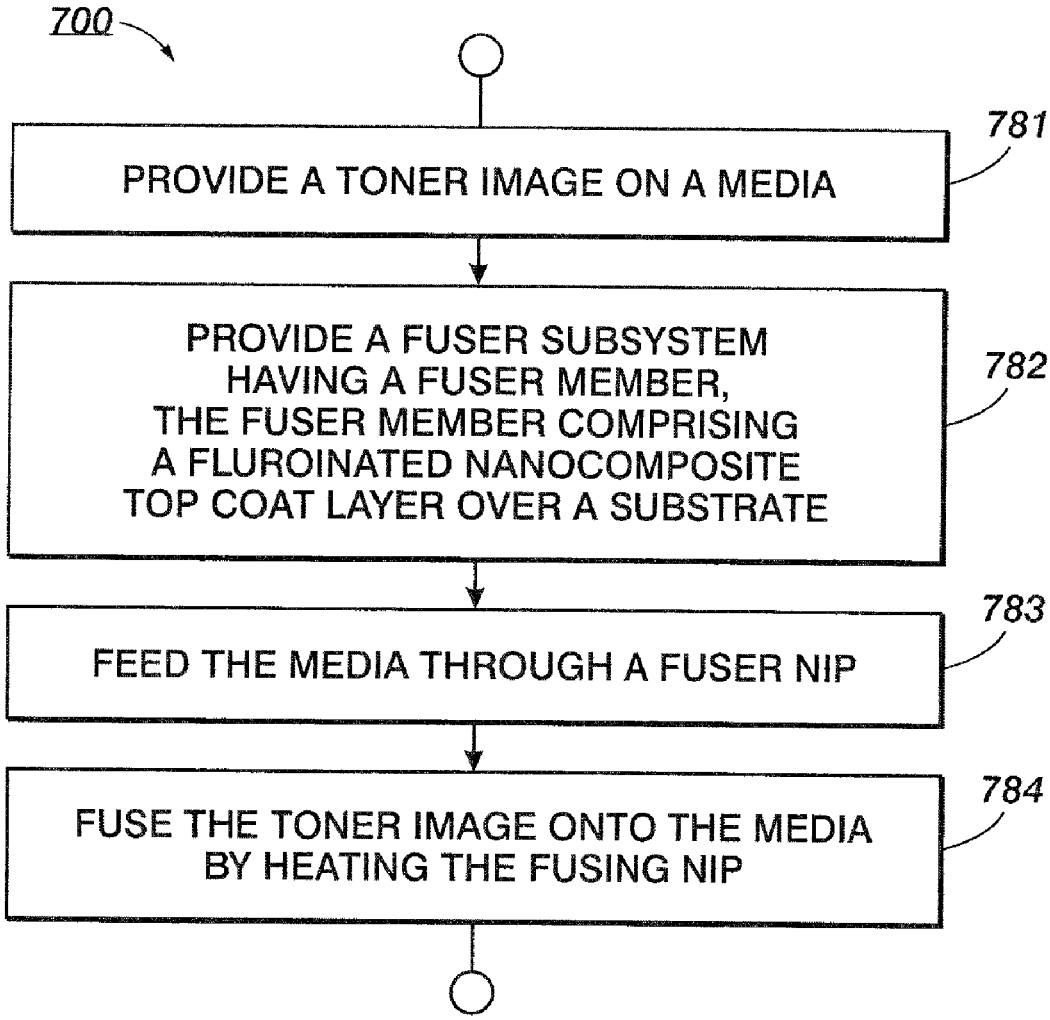
FIG. 7 shows an exemplary method of forming an image, according to various embodiments of the present teachings.

According to various embodiments, there is an exemplary method 600 of making a member of a fuser subsystem, as shown in FIG. 6. The method 600 can include a step 661 of providing a fuser member, the fuser member including a substrate and a step 662 of forming one or more functional layers such as, for example, a compliant layer over the substrate. In various embodiments, the fuser member can include a substrate having any suitable shape, such as, for example, a cylinder and a belt. The method 600 can also include a step 663 of forming a top coat layer including a fluorinated nanocomposite over the one or more functional layers, wherein the fluorinated nanocomposite can include a plurality of fluorinated carbon nanotubes dispersed in one or more fluoropolymers. In various embodiments, the step 663 of forming a top coat layer over the one or more functional layers can include melt blending a plurality of fluorinated carbon nanotubes and one or more fluoropolymers to form a fluorinated nanocomposite and melt extruding the fluorinated nanocomposite over the one or more functional layers. In certain embodiments, the step of melt blending fluorinated carbon nanotubes and one or more fluoropolymers can include adding fluorinated carbon nanotubes in an amount of from about 0.1 to about 15.0 percent by weight of the total solid weight of the fluorinated nanocomposite. Chen et. al., in Macromolecules, 2006, Vol. 39, No. 16, pp. 5427-5437 disclosed a method of of melt blending fluorinated multiwalled carbon nanotube (MWNT) and fluorinated ethylene-propylene copolymer (FEP) and melt spinning the composite, which is incorporated by reference herein in its entirety. One of ordinary skill in the art can apply Chen et. al.'s method of melt blending and melt spinning to form fluorinated nanocomposites of other fluorinated carbon nanotubes and fluoropolymers, such as, for example, poly(tetrafluoroethylene) and perfluoroalkoxycopolymer. However, any other suitable method of melt blending and melt spinning/melt extruding can be used. FIG. 7 shows an exemplary method 700 of forming an image, according to various embodiments of the present teachings. The method 700 can include providing a toner image on a media, as in step 781. The method 700 can also include a step 782 of providing a fuser subsystem including a fuser member, the fuser member including one or more functional layers disposed over a substrate and a top coat layer including a fluorinated nanocomposite disposed over the one or more functional layers, wherein the fluorinated nanocomposite can include a plurality of fluorinated carbon nanotubes dispersed in one or more fluoropolymers. In some embodiments, the step 782 of providing a fuser subsystem can include providing the fuser subsystem in a roller configuration. In other embodiments, the step 782 of providing a fuser subsystem can include providing the fuser subsystem in a belt configuration. In some other embodiments, the step 782 of providing a fuser subsystem can include providing the fuser subsystem in a transfix configuration. In various embodiments, the fuser member of the fuser subsystem can include one or more of a fuser roll, a fuser belt, a pressure roll, a pressure belt, a transfix roll, and a transfix belt. The method 700 can further include a step 783 of feeding the media through a fuser nip such that the toner image contacts the top coat layer of the fuser member in the fuser nip and a step 784 of fusing the toner image onto the media by heating the fusing nip.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printing apparatus comprising:

a fuser member, the fuser member comprising a substrate;

one or more functional layers disposed over the substrate; and a top coat layer comprising a fluorinated nanocomposite disposed over the one or more functional layers, wherein the fluorinated nanocomposite comprises a plurality of fluorinated multi-walled carbon nanotubes dispersed in one or more fluoropolymers selected from the group consisting of perfluoroalkoxycopolymer, poly(tetrafluoroethylene), fluorinated ethylene-propylene copolymer, and combinations thereof, and wherein the top coat layer comprises a thickness ranging from about 10 micron to about 75 micron.

2. The printing apparatus of claim 1, wherein the fluorinated nanocomposite further comprises fluorinated single-walled carbon nanotubes and/or fluorinated double-walled carbon nanotubes.

3. The printing apparatus of claim 1, wherein the one or more fluoropolymers consists of one fluoropolymer and that fluoropolymer is poly(tetrafluoroethylene), fluoro-ethylene-propylene copolymer, or perfluoroalkoxycopolymer.

4. The printing apparatus of claim 1, wherein the fluorinated multi-walled carbon nanotubes are present in an amount of from about 0.1 to about 15.0 percent by weight of the total solid weight of the fluorinated nanocomposite.

5. The printing apparatus of claim 1, wherein the substrate has a shape selected from the group consisting of a cylinder and a belt.

6. The printing apparatus of claim 1, wherein the fuser member is selected from the group consisting of a fuser roll, a fuser belt, a pressure roll, a pressure belt, a transfix roll, and a transfix belt.

7. The printing apparatus of claim 1, wherein one of the one or more functional layers is a compliant layer, the compliant layer comprising a material selected from a group consisting of a silicone, a fluorosilicone and a fluoroelastomer.

8. The printing apparatus of claim 1, wherein the printing apparatus is one of a xerographic printer and a solid inkjet printer.

9. A method of making a member of a fuser subsystem, the method comprising:

providing a fuser member, the fuser member comprising a substrate;

forming one or more functional layers over the substrate; and forming a top coat layer comprising a fluorinated nanocomposite over the one or more functional layers, wherein the fluorinated nanocomposite comprises a plurality of fluorinated multi-walled carbon nanotubes dispersed in one or more fluoropolymers selected from the group consisting of perfluoroalkoxycopolymer, poly (tetrafluoroethylene), fluorinated ethylene-propylene copolymer, and combinations thereof, and wherein the top coat layer comprises a thickness ranging from about 10 micron to about 75 micron.

10. The method of making a member of a fuser subsystem according to claim 9, wherein the step of forming a top coat layer comprising a fluorinated nanocomposite over the one or more functional layers comprises:

melt blending a plurality of fluorinated multi-walled carbon nanotubes and one or more fluoropolymers to form a fluorinated nanocomposite; and melt extruding the fluorinated nanocomposite over the one or more functional layers.

11. The method of making a member of a fuser subsystem according to claim 9, wherein the fluorinated nanocomposite further comprises fluorinated single-walled carbon nanotubes and/or fluorinated double-walled carbon nanotubes.

12. The method of making a member of a fuser subsystem according to claim 10, wherein the step of melt blending fluorinated multi-walled carbon nanotubes and one or more fluoropolymers comprises adding fluorinated multi-walled carbon nanotubes in an amount of from about 0.1 to about 15.0 percent by weight of the total solid weight of the fluorinated nanocomposite.

13. The method of making a member of a fuser subsystem according to claim 9, wherein the step of providing a fuser member, the fuser member comprising a substrate comprises providing a fuser member, the fuser member comprising a substrate having a shape selected from the group consisting of a cylinder, a belt, and a sheet.

14. A method of forming an image comprising:

providing a toner image on a media;

providing a fuser subsystem comprising a fuser member, the fuser member comprising one or more functional layers disposed over a substrate and a top coat layer comprising a thickness ranging from about 10 micron to about 75 micron and comprising a fluorinated nanocomposite disposed over the one or more functional layers, wherein the fluorinated nanocomposite comprises a plurality of fluorinated multi-walled carbon nanotubes dispersed in one or more fluoropolymers selected from the group consisting of perfluoroalkoxycopolymer, poly (tetrafluoroethylene), fluorinated ethylene-propylene copolymer, and combinations thereof;

feeding the media through a fuser nip such that the toner image contacts the top coat layer of the fuser member in the fuser nip; and fuse the toner image onto the media by heating the fuser nip.

15. The method of forming an image according to claim 14, wherein the fluorinated nanocomposite further comprises fluorinated single-walled carbon nanotubes and/or fluorinated double-walled carbon nanotubes.

16. The method of forming an image according to claim 14, wherein the one or more fluoropolymers consists of one fluoropolymer and the fluoropolymer is poly(tetrafluoroethylene), fluoro-ethylene-propylene copolymer, or perfluoroalkoxycopolymer.

17. The method of forming an image according to claim 14, wherein the fluorinated multi-walled carbon nanotubes are present in an amount of from about 0.1 to about 15.0 percent by weight of the total solid weight of the fluorinated nanocomposite.

18. The method of forming an image according to claim 14, wherein the step of providing a fuser subsystem comprising a fuser member comprises providing a fuser subsystem comprising one or more of a fuser roll, a fuser belt, a pressure roll, a pressure belt, a transfix roll, and a transfix belt.

* * * * *